United States Patent [19]

Henderson et al.

[11] Patent Number: 4,809,444

[45] Date of Patent: Mar. 7, 1989

[54] HAIR DRYING AND SETTING APPARATUS

[76] Inventors: Lemuel Henderson; Elaine H. Henderson, both of 3575 Huasha Rd., Arroyo Grande, Calif. 93420

[21] Appl. No.: 98,627

[22] Filed: Sep. 21, 1987

[51] Int. Cl.[4] ..... A45D 4/00

[52] U.S. Cl. ..... 34/98; 34/99

[58] Field of Search ..... 132/7, 9; 34/96, 98, 34/99, 101

[56] References Cited

U.S. PATENT DOCUMENTS

| | | | |
|---|---|---|---|
| 3,241,560 | 3/1966 | Willat | 132/9 |
| 3,444,624 | 5/1969 | Greenlee | 34/98 |

FOREIGN PATENT DOCUMENTS

| | | | |
|---|---|---|---|
| 977300 | 3/1951 | France | 34/98 |
| 1385551 | 12/1964 | France | 34/98 |

*Primary Examiner*—Henry A. Bennet

*Attorney, Agent, or Firm*—I. Michael Bak-Boychuk

[57] ABSTRACT

A hair setting assembly including a hollow base provided with an electrical motor attached to drive a fan in a perforated enclosure affixed to the base. The air flow from the fan is then conveyed through a vertical, tubular extension, across heating filaments, to a flexible joint and thereafter to a distribution assembly includes a cylindrical cap telescopically affixed on a shaped end of a tube to selectively expose one or more openings to the airflow. Flexible hoses may then be inserted into the exposed openings to convey the heated air flow into hair rollers.

2 Claims, 2 Drawing Sheets

FIG. 3
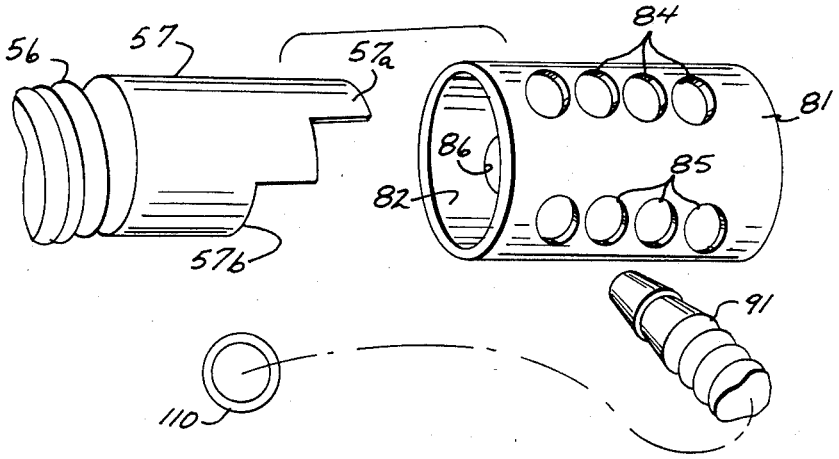
FIG. 4
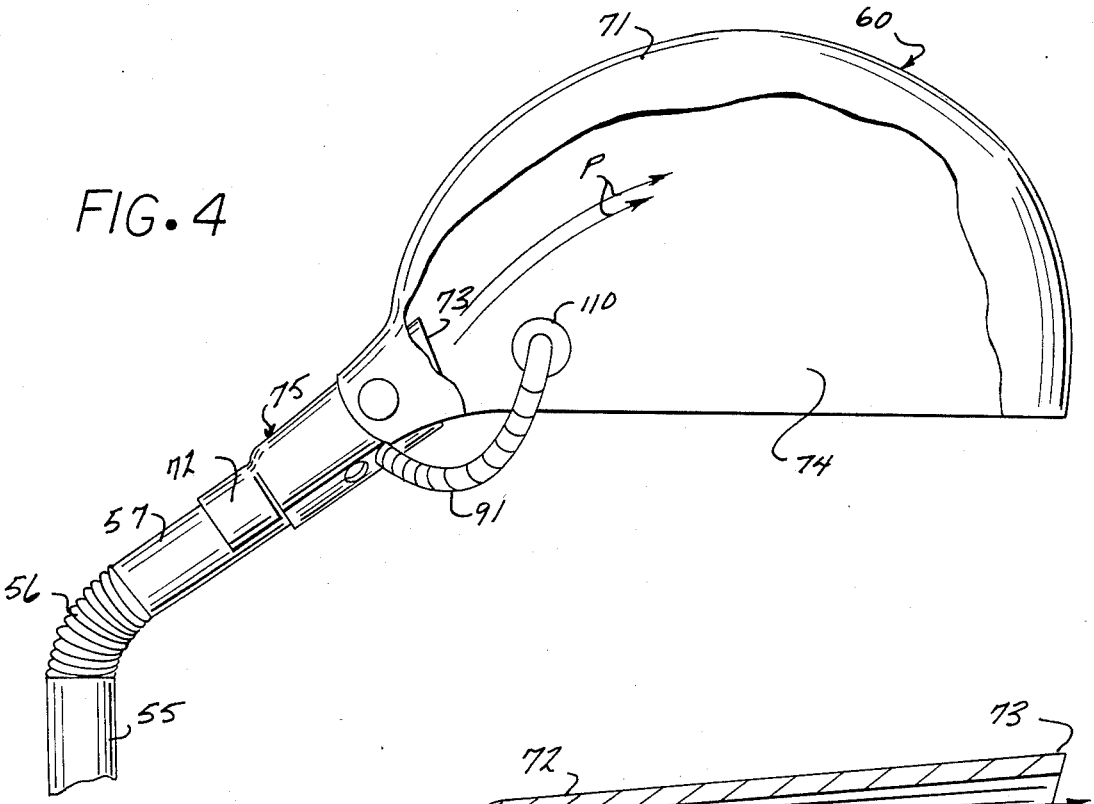
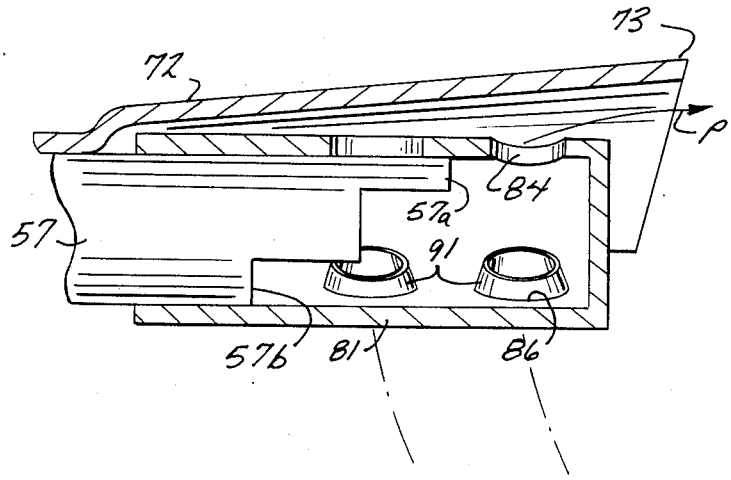
FIG. 5

HAIR DRYING AND SETTING APPARATUS

BACKGROUND OF THE INVENTION

1. Field of the Invention

The present invention relates to hair drying and setting apparatus and, more particularly, to distribution apparatus for selectively directing forced, heated air into hair rollers and/or a drying hood.

2. Description of the Prior Art

Hair drying devices of various forms have been devised in the past. In the most typical form such prior art hair drying devices include a source of heat and an air blower which directs ambient air across the source and then onto the hair of the user. Devices of this kind, while suitable for their purpose, lack the precision, convenience, and control that is sometimes required in a commercial hair styling establishment.

Consequently, a hair drying structure conformed to convey heated air directly into hair rollers has been previously devised, as exemplified by the teachings of U.S. Pat. No. 3,241,560 to Willat. While suitable for the purposes intended the foregoing U.S. patent conforms the structure thereof as a manifolded conduit arrangement extending from one end of a canister. Thus, the apparatus is useful for a single purpose primarily and consequently comprises an added item of equipment to the hair salon operator.

Accordingly, an arrangement of expanded functional scope is desired and it is one such arrangement that is disclosed herein.

SUMMARY OF THE INVENTION

Accordingly, it is the general purpose and object of the present invention to provide a drying assembly conformed to selectively convey drying air into the interior of hair rollers and to direct air onto the roller exterior.

Other objects of the invention are to provide a multifunctional hair drying assembly arranged for convenient selection.

Yet further objects of the invention are to provide a hair drying assembly convenient in use, easily fabricated and requiring little maintenance.

Briefly, these and other objects are accomplished within the present invention by providing a substantially cylindrical housing including a base for the support thereof onto which an electric motor is mounted. A noiseless fan is then fixed to the shaft of the motor to draw ambient air through apertures in the housing into a heater filament assembly stacked onto the fan outlet. The air heated by the filaments is then conveyed into a vertical telescoping tube attached to a bendable neck from which an end fitting ensemble is deployed, comprising a sleeve in which a plurality of holes is formed and which is selectively verniered against a shaped edge of the neck. The operator, therefore, may conveniently select the number of openings exposed to the air flow.

Having thus selected the openings necessary for use the operator then connects flexible tube segments between each opening and a corresponding perforated roller around which locks of hair are wound. Selected other openings may then be left unconnected and are thus useful to convey heated air into a manipulated hood assembly.

Thus, the hair is selectively dried, and therefore set, both by exterior air flow and by the air passed into the interior of the rollers. In consequence close control over the hair styling process may be achieved in a convenient, simply effected structure.

More importantly, as conformed, the inventive apparatus may be used in various alternatives providing the major equipment components for those engaged in the business of hair styling. The consequent reduction in equipment obtains substantial capital savings as well as a reduction in operating cost associated with a large equipment complement.

BRIEF DESCRIPTION OF THE DRAWINGS

FIG. 3 is a perspective detail, separated by parts, of a selective distribution arrangement in accordance with the present invention;

FIG. 4 is a side view detail, in partial section, of the inventive hair setting assembly conformed in one of its alternatives; and FIG. 5 is a sectional view taken along line 5—5 of FIG. 4.

DESCRIPTION OF THE PREFERRED EMBODIMENTS

Figure 1:
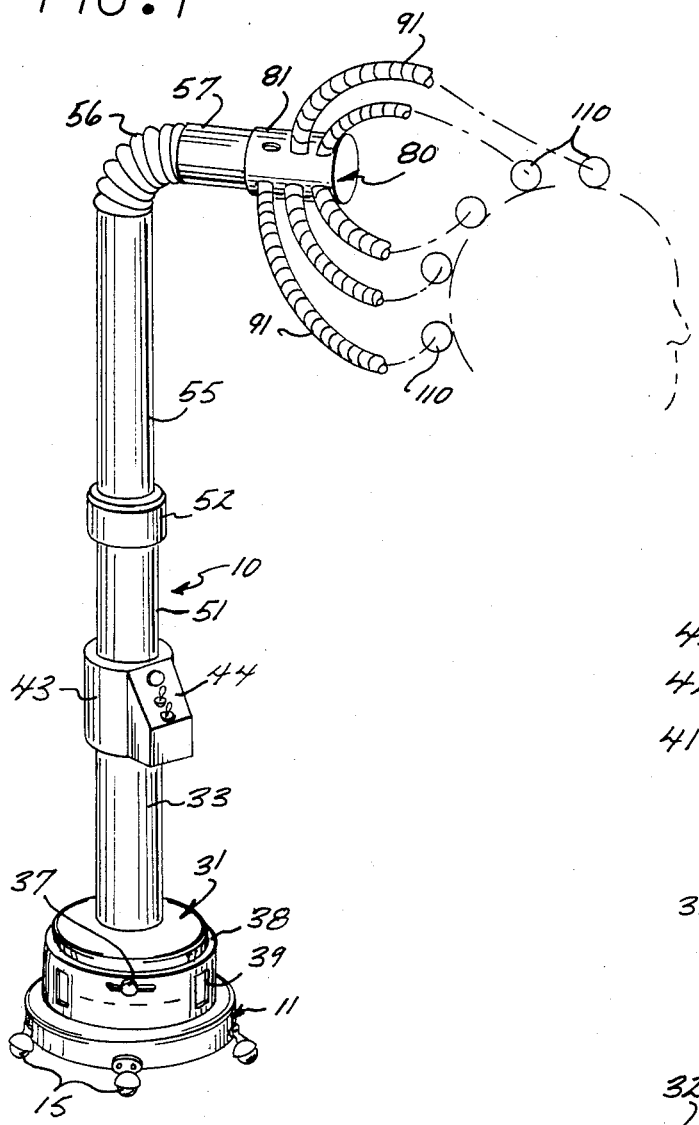
FIG. 1 is a perspective illustration of the inventive hair setting assembly, and more particularly, the base portion thereof.
Figure 2:
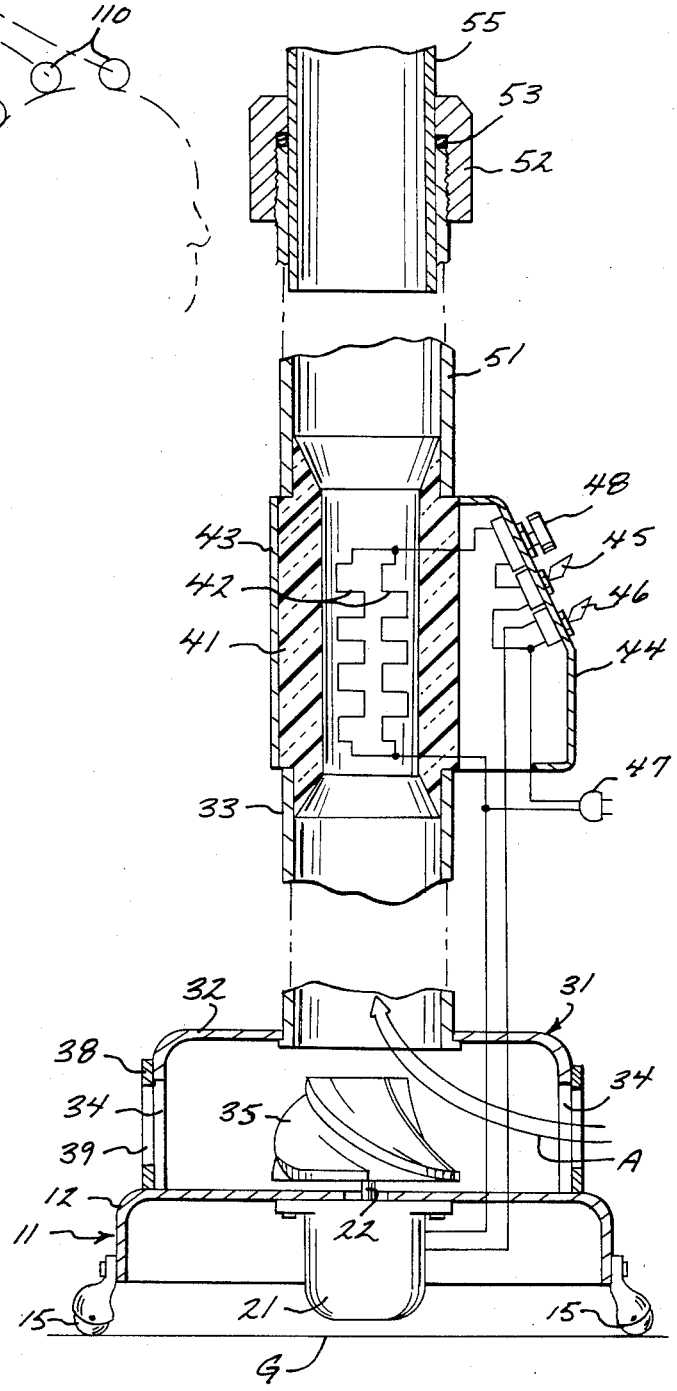
FIG. 2 is a side view, in section, of the inventive hair setting assembly shown in FIG. 1.

As shown in FIGS. 1–5, the inventive hair drying assembly, generally designated by the numeral 10, includes a substantially circular dished base 11 characterized by a skirt 12 around the periphery of a base surface 13. As thus formed base 11 is aligned with its dished side towards the ground G, supported in spaced relationship thereabove by a plurality of casters 15. An electric motor 21 is then fixed centrally within the dished cavity, in suspended mounting from surface 13, to extend its output shaft 22 above the surface.

Fixed to the exterior of base 11, in vertical alignment thereabove, is a further hollow housing 31 generally in the form of an inverted dish 32 from which a vertical tube 33 extends. Dish 32, at its peripheral edge, is provided with a plurality of slots 34 communicating with its interior. A noiseless fan 35 is then deployed on shaft 22 within the cavity formed in the dish to draw ambient air along the arrows A through the slots 34 into the interior of tube 33. Tube 33, at its upper end, then mates with an annular high temperature insert 41 in which a plurality of electrical heating filaments 42 are deployed. A housing assembly 43 surrounds insert 41 both for insulation and to support a control panel 44 thereon. On this panel control switches 45 and 46 are positioned to complete the circuit motor. Panel 44, moreover, may include a thermostat 48 in circuit with the filaments for control of the temperature of the air flow.

Insert 41 then mates with a coaxial upper tube segment 51 terminating in a cinch nut 52 compressing a packing ring 53 against its upper end. A telescopically received tubular slide 55 is thus cinched at any selected increment of extension from segment 51. Slide 55 attaches to a convolved bellows segment 56 which, in turn, engages an end tube 57.

It is this end tube that can then be aligned adjacent the head of the person services, both by the deformation of the bellows and by the telescopic height adjustment. The tube end is thus positioned both to support a drying enclosure generally at 60 and a manifold outlet shown at 80.

More specifically, outlet 80 comprises an outer cylindrical cap 81 closed at one end and including an interior bore 82 conformed to receive the end tube 57. The lateral surface 83 is perforated along radially spaced rows with circular perforations 84, 85 and 86 at unequal radial increments. Concurrently, the received end edge of tube 57 is shaped to extend as an overhanging lip 57*a* along one radial increment and is recessed as a recess 57*b* spanning another radial segment. The linear (axial) extension of the lip and recess span the axial spacing interval between the adjacent perforations 84, 85 and 86. Thus, by selective turning of the cylindrical end cap 81 on the end tube 57 and by axial displacement thereof any desired number of openings is exposed to the air flow. A corresponding set of flexible hose segments 91 may then be inserted into the exposed perforations each then connected at the other end to a perforated roller 110.

Rollers 110 may be variously devices, one examplary form thereof being shown at FIGS. 6–12 inclusive of U.S. Pat. No. 3,241,560 to Willat. Preferrably such rollers include an outer, split clip and a perforated tubular inner piece conformed to receive the end of tube 91 in its interior. Thus, the air flow therethrough will depend on the number of rollers connected, the perforation area therein, and the air flow delivered.

To provide control over the air flow delivered to the rollers an annular ring 38 is positioned around the slots 34 in the skirt forming the cavity 31. This annular ring includes radial openings 39 which then combine with the slots 34 to define the inlet aperture. Of course, various selection and securing mechanisms 37 are then useful in fixing this alignment.

Thus, any selected roller complement and air flow may be accommodated by this arrangement. Furthermore, the cap 81 may be used in conjunction with a hood assembly 70 including a hood 71 pivoted from a mount 75 provided with a resilient U-shaped clip 72 at one side conformed to engage the end tube 57. Mount 75 expands as a tapered throat or funnel 73 adjacent cap 81 and communicates into the cavity 74. When positioned onto the end tube funnel 73 then directs any air flow into a fanned out stream pattern P on the interior of the cavity 74.

Thus, by exposing one or more of the openings 84, 85 and 86 an air flow within the hood 71 and concurrently into the rollers 110 is effected. The operator thus has all the necessary options to effect such styling technique as may be necessary.

Obviously many modifications and changes may be made without departing from the spirit of the invention. It is therefore intended that the scope of the invention be determined solely on the claims appended hereto.

What is claimed is:

1. A hair setting assembly comprising:

a hollow base conformed to be supported on ground;

motor means received within said base including a rotary output shaft aligned to extend above said base;

an annular enclosure mounted on said base in coaxial alignment with said output shaft, said enclosure including a plurality of apertures in the surface thereof;

a fan attached to said output shaft with said enclosure and aligned to draw ambient air through said apertures;

tubular conveying means mounted on said enclosure and aligned to receive the air conveyed by said fan including heating means in the interior thereof exposed to said air communicating therethrough, said heating means including a thermally resistive annular insert interposed within said tubular conveying means including electrical heating filaments deployed on the interior thereof;

flexible connection means attached to said tubular conveying means for selective alignment of said air flow therethrough; and distribution means operatively connected to said connection means for directing said flow into predetermined flexible hoses, said distribution means including a tubular segment having an axially shaped free edge, a cylindrical cap conformed for placement on said segment provided with a plurality of openings selectively aligned for closure of one or more thereof by said shaped edge, and flexible hoses receivable in said openings and conformed for insertion into a hair roller.

2. Apparatus according to claim 1 further comprising:

a pivotal hood assembly selectively engageable to said distribution means and aligned to receive the air flow from one or more of said openings.

* * * * *